US005839724A

United States Patent [19]

Bunac, Jr.

[11] Patent Number: 5,839,724

[45] Date of Patent: Nov. 24, 1998

[54] PORTABLE TARGET GAME APPARATUS

[76] Inventor: Felix Juan Bunac, Jr., 8032 Pocket Rd., #263, Sacramento, Calif. 95831

[21] Appl. No.: 974,937

[22] Filed: Nov. 20, 1997

Related U.S. Application Data

[60] Provisional application No. 60/031,686 Nov. 22, 1996.

[51] Int. Cl. [6] ..... A63B 67/00

[52] U.S. Cl. ..... 273/127 R; 273/123 R; 273/118 R; 473/19

[58] Field of Search ..... 273/118 R, 123 R, 273/127 R, 127 B, 108; 473/19, 185, 173, 174

[56] References Cited

U.S. PATENT DOCUMENTS

| | | | |
|---|---|---|---|
| 497,452 | 5/1893 | Malinowski | 473/19 |
| 723,378 | 3/1903 | Fuller | 273/123 R |
| 771,210 | 9/1904 | Sausen | 273/123 R |
| 828,211 | 8/1906 | Johnson | 273/123 R |
| 1,086,959 | 2/1914 | Vinton | 273/123 R |
| 1,400,461 | 12/1921 | Sacane | 473/19 |
| 1,409,527 | 3/1922 | Debelack et al. | 473/19 |
| 1,578,005 | 3/1926 | Brooks | 473/19 |
| 1,814,520 | 7/1931 | Miller | 473/19 |
| 4,148,487 | 4/1979 | Bouve . | |
| 5,029,863 | 7/1991 | Krawczyk et al. | 273/123 R X |
| 5,183,254 | 2/1993 | Jones . | |

*Primary Examiner*—Raleigh W. Chiu

[57] ABSTRACT

Portable target game apparatus positionable on a pool table or other support includes an inclined board having target holes for receiving balls rolled onto the board. Straight side walls and a straight back wall are attached to the board and extend upwardly from the board. Connector walls are diagonally disposed relative to the back and side walls and interconnect the back and side walls. Resilient material is connected with the back wall, the side walls and the connector walls to redirect movement of balls on the ball support surface.

3 Claims, 2 Drawing Sheets

PORTABLE TARGET GAME APPARATUS

Filing benefit is claimed based on U.S. Provisional Application No. 60/031,686, filed Nov. 22, 1996.

TECHNICAL FIELD

This invention relates to an apparatus utilized in a game of skill. More particularly, the apparatus is employed with balls, for example balls employed in the game of pool. The apparatus is particularly adapted for use on the playing surface of a pool table.

BACKGROUND ART

U.S. Pat. No. 4,148,487, issued Apr. 10, 1979, discloses a surface game target apparatus in the nature of a game board that is positioned on a level surface, such as a floor or a billiard table. The game board has a plurality of holes formed therein into which balls are rolled, the game board being inclined during such activity. The game board of U.S. Pat. No. 4,148,487 includes a U-shaped, inclined border about which the balls may be rolled during play. The inclined border is not resilient and does not function as a surface from which the balls bounce and are deflected. In fact, it appears from the disclosure of U.S. Pat. No. 4,148,487 that a ball engaging the inclined border at a certain speed and angle could readily roll up and over the inclined border and exit the game board altogether. This limits the type of play available.

U.S. Pat. No. 5,183,254, issued Feb. 2, 1993, discloses a portable game accessory for use with a billiard-type table consisting of a planar overlay that carries special game target indicia. The overlay is in the nature of a thin, flat sheet having edges sufficiently thin to enable a billiard ball to roll onto the upper surface of the overlay without deflection of the billiard ball to change its direction.

DISCLOSURE OF INVENTION

The present invention relates to a portable target game apparatus which is particularly adapted to be positioned on and cooperate with a pool table. The term pool table as employed herein encompasses both pool tables and other billiard-type tables.

The apparatus incorporates a unique combination of structural elements which enable a billiard ball or other ball employed therewith to be bounced and deflected in many different directions during play.

The portable target game apparatus of the present invention includes a board positionable on a support such as the playing surface of a pool table. The board has a substantially flat, upwardly directed ball support surface defining a plurality of target holes for receiving balls rolled onto the ball support surface.

The board includes a board front, a board back, and board sides. The target holes are spaced from one another and spaced from the board front, the board back, and the board side.

The ball support surface is inclined and the board front located lower than the board back when the board is positioned on a support.

A straight back wall is attached to the board and extends substantially vertically upwardly from the ball support surface and linearly along the board back.

Straight side walls are attached to the board and extend substantially vertically upwardly from the ball support surface and linearly along the board sides.

Resilient material is connected to the back wall and the side walls which is engageable by balls rolled onto the ball support surface to redirect movement of the balls on the ball support surface.

The portable target game apparatus additionally includes a pair of straight connector walls attached to the board and extending substantially vertically upwardly from the ball support surface. Each connector wall of the pair of connector walls extends between and it is diagonally disposed with respect to one of the side walls and the back wall.

Resilient material is connected to the connector walls which is engageable by balls rolled onto the ball support surface to redirect movement of the balls.

Other features, advantages, and objects of the present invention will become apparent with reference to the following description and accompanying drawings.

BEST MODE FOR CARRYING OUT THE INVENTION

Figure 6:
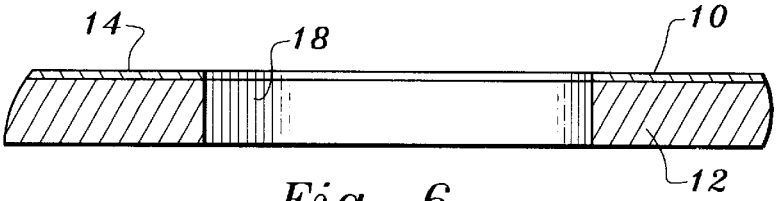
FIG. 6 is a greatly enlarged cross-sectional view taken along the line 6—6 in FIG. 5 and illustrating the laminated construction of the board surrounding a target hole.

Referring now to the drawings, apparatus constructed in accordance with the teachings of the present invention includes a board 10 which is of rigid construction. As shown in FIG. 6, the board 10 is in the nature of a laminate, the bottom layer 12 thereof being formed of wood or other suitable material and the top layer 14 being a hard, impact resistant smooth material such as plastic.

Figure 1:
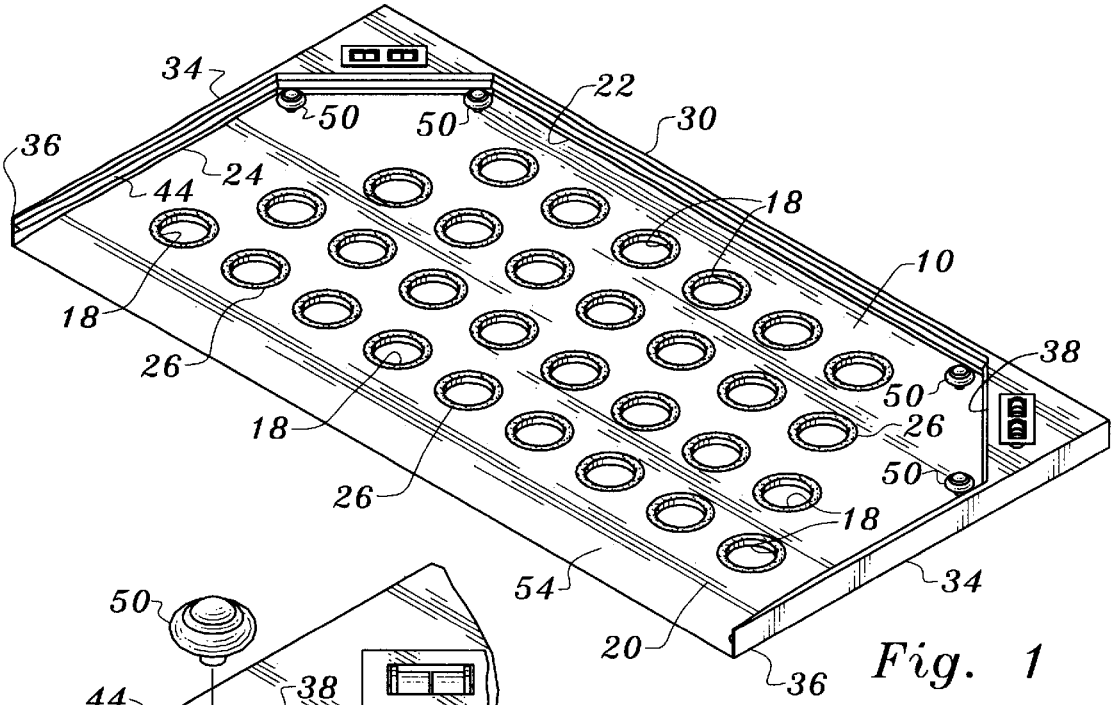
FIG. 1 is a perspective view of portable target game apparatus constructed in accordance with the teachings of the present invention.
Figure 2:
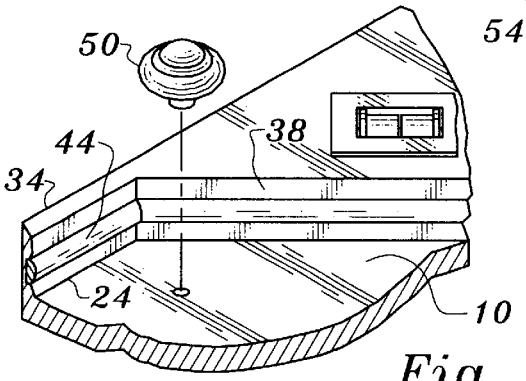
FIG. 2 is an enlarged partial sectional view illustrating a segment of the board and a bumper member for selective removable connection to the board.
Figure 3:
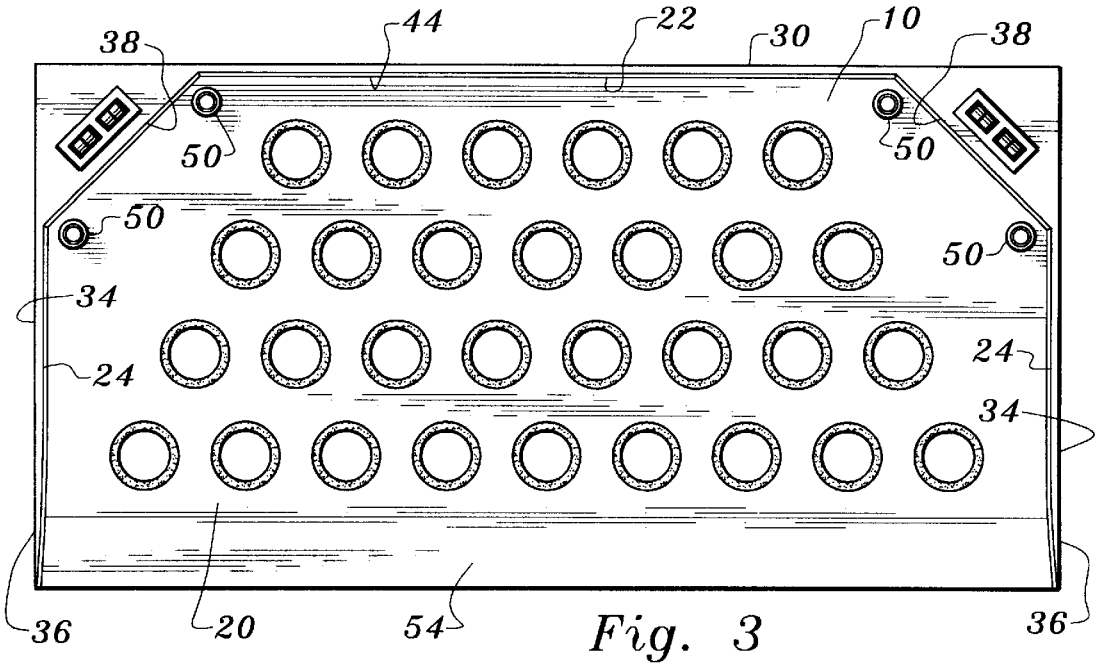
FIG. 3 is a top plan view of the apparatus.
Figure 4:
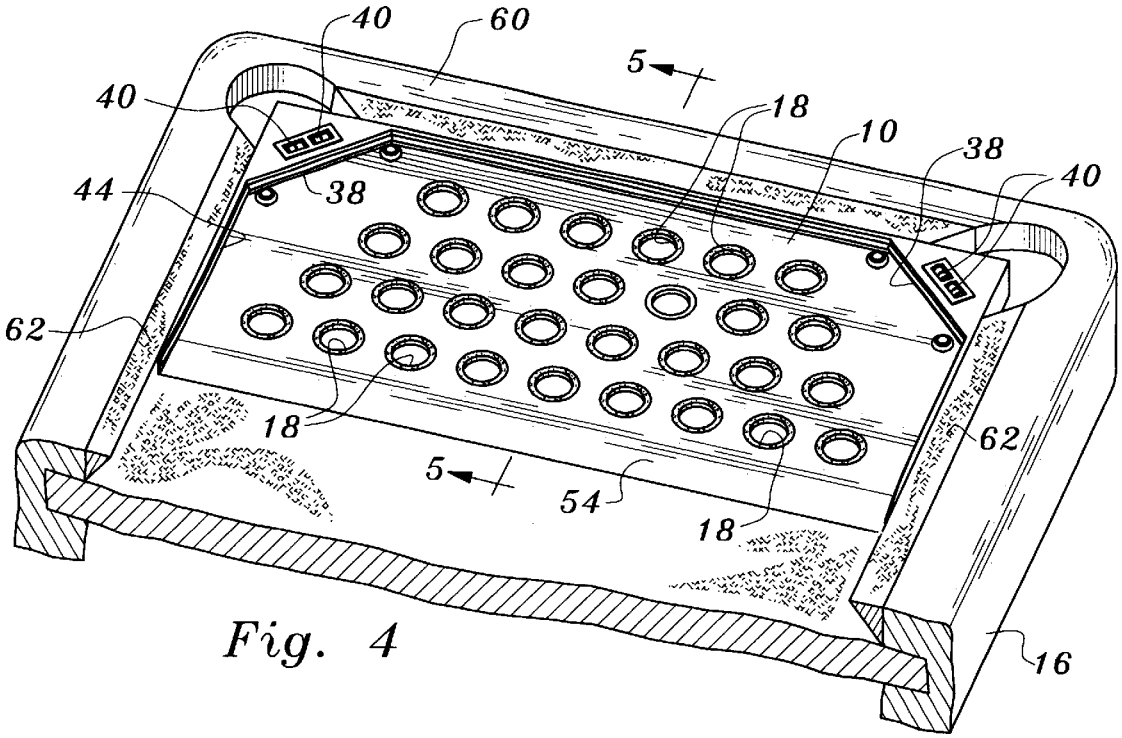
FIG. 4 is a perspective view illustrating the apparatus in position at an end of a pool table, only a portion of the latter being illustrated.
Figure 5:
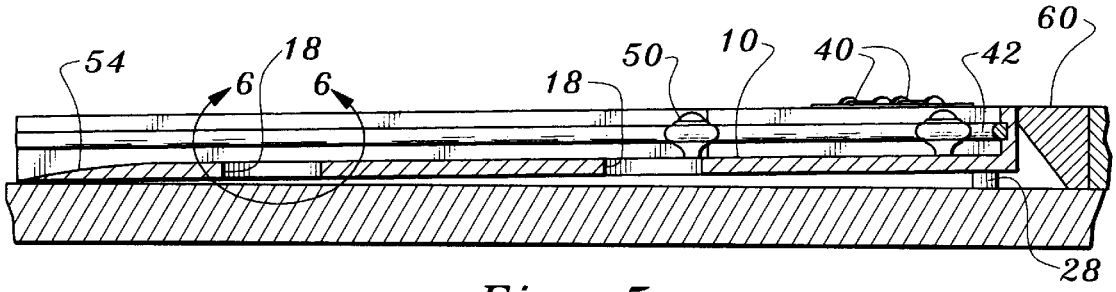
FIG. 5 is an enlarged cross-sectional view taken along the line 5—5 of FIG. 4.

The board is positionable on a support, such as the playing surface of a pool table 16 (FIGS. 4 and 5).

Board 10 has a flat, upwardly directed ball support surface defining a plurality of target holes 18 for receiving balls rolled onto the ball support surface. The board includes a board front 20, a board back 22, and board sides 24.

The target holes 18 are spaced from one another and spaced from the board front, the board back and the board sides. Indicia such as rings 26 are imprinted on the board at the locations of the target holes. Suitable supplemental indicia such as numbers may also be associated with the target holes. The rings 26 may be of different colors. The purpose of such indicia is to assign game or score values to the target holes, such values for example being those of particular balls utilized in the game of pool.

The ball support surface of the board is inclined when the board is positioned on a support so that the board front is lower than the board back. Board support members such as one or more legs 28 (FIG. 5) may be employed to provide the inclination.

A straight back wall 30 is attached to the board in any suitable manner and extends vertically upwardly from the ball support surface and linearly along the board back 22.

Straight side walls 34 are attached to the board by any suitable expedient and extend vertically upwardly from the ball support surface and linearly along the board sides 24. The distal ends 36 of the side walls are tapered.

A pair of straight connector walls 38 are attached to the board and extend vertically upwardly from the board surface. Each connector wall extends between and is diagonally disposed with respect to one of the side walls 34 and the back wall 30. In the embodiment illustrated, each connector wall forms a forty-five degree angle with a side wall and the back wall.

Immediately adjacent to the connector walls 38 and mounted in the structure forming the connector walls are counters 40 (preferably two counters at each corner) of any suitable type utilized to tally points scored by individuals playing with the portable target game apparatus.

Attached to side walls 34, back wall 30 and connector walls 38 is resilient ball bumper means which, in the embodiment illustrated, comprises an elongated strip 44 of rubber or other suitable resilient material which is secured in any suitable manner, such as adhesive, to the lengths of back wall 30, side walls 34, and connector walls 38.

Resilient bumper members 50 are connected to board 10 and extend upwardly from the ball support surface at spaced locations on the board. More particularly, the resilient bumper members 50 in the embodiment disclosed are located at the ends of connector walls 38 where the connector walls join back wall 30 and side walls 34. Preferably the resilient bumper members are releasably connected to the board so that they may be removed if desired. Any suitable mechanical means such as screws or other mechanical fasteners may be employed for this purpose or the lower ends of the bumper members may simply be sized to enter holes formed in the board and frictionally held in position on the board.

A ball entry ramp 54 is attached to the board 10. In the illustrated preferred embodiment, the ramp is integrally formed with the board and simply comprises an extension thereof. The ramp has a ramp surface adjacent and leading to the ball support surface of the board and which is inclined upwardly in the direction of the ball support surface.

The apparatus disclosed is of a size and configuration to nest at the end of pool table 16. However, the apparatus need not necessarily be utilized with a pool table.

When, however, the apparatus is utilized with a pool table and positioned on the playing surface thereof, the straight back wall 30 of the apparatus is in close proximity to and parallel with an end rail 60 of the pool table and the straight side walls of the apparatus are in close proximity to and parallel with spaced parallel side rails 62 of the pool table.

In operation, balls such as billiard balls (not shown) are rolled along the playing surface of the pool table up the ramp 54, and then onto the ball support surface of the board 10. The object, of course, is to place the balls in the target holes. The player or players may suitably bounce the balls off of the resilient strip 44 to redirect the balls at angles dictated by the initial direction of the ball and the particular wall or walls of the apparatus engaged thereby. If the resilient bumper members 50 are installed, they too can be utilized to redirect ball movement. The balls may also be bounced off the tapered distal ends of the side walls. It will be appreciated that considerable ball action is thus obtained and the skills of a player challenged.

I claim:

1. Portable target game apparatus comprising, in combination:

a board positionable on a support, said board having a substantially flat, upwardly directed ball support surface defining a plurality of target holes for receiving balls rolled onto said ball support surface, said ball support surface having indicia thereon located adjacent to said target holes designating game or score values assigned to said target holes and said board including a board front, a board back, and board sides, said target holes being spaced from one another and spaced from said board front, said board back, and said board sides, said ball support surface being inclined and said board front located lower than said board back when said board is positioned on a support;

a straight back wall attached to said board and extending substantially vertically upwardly from said ball support surface and linearly along said board back;

straight side walls attached to said board and extending substantially vertically upwardly from said ball support surface and linearly along said board sides, said side walls being disposed at right angles to said back wall and parallel to one another;

resilient material connected to said back wall and said side walls engageable by balls rolled onto said ball support surface from said board front to redirect movement of said balls on said ball support surface;

a pair of double-ended straight connector walls attached to said board and extending substantially vertically upwardly from said ball support surface, each connector wall of said pair of connector walls connected at the ends thereof to, extending between, and diagonally disposed with respect to one of said side walls and said back wall, and resilient material connected to said connector walls and extending between the ends thereof engageable by balls rolled onto said ball support surface from said board front to redirect movement of the balls;

a ball entry rams attached to said board at said board front and having a ramp surface adjacent to said ball support surface and inclined upwardly in the direction of said ball support surface; and a plurality of resilient bumper members connected to said board with a resilient bumper member extending upwardly from said ball support surface immediately adjacent to each of the ends of said connector walls for impact by balls on said ball support surface received from said ball entry ramp and capable of redirecting the motion of said balls after impact along said ball support surface toward any of said target holes.

2. The portable target game apparatus according to claim 1 being of a size and configuration to nest at the end of a pool table with said back wall and said side walls closely adjacent to and parallel with said pool table cushion rails.

3. The portable target game apparatus according to claim 1 wherein said board is formed of stiff, laminated material.

* * * * *